United States Patent [19]

Sakamoto et al.

[11] 4,319,832

[45] Mar. 16, 1982

[54] TONER SEPARATION AND RECOVERY APPARATUS

[75] Inventors: Koji Sakamoto; Masayuki Hayashi; Yutaka Koizumi; Misao Tanzawa, all of Tokyo, Japan

[73] Assignee: Ricoh Company, Ltd., Tokyo, Japan

[21] Appl. No.: 108,979

[22] Filed: Jan. 3, 1980

[30] Foreign Application Priority Data

Jan. 29, 1979 [JP] Japan ..... 54-10430[U]

[51] Int. Cl.[3] ..... G03G 21/00

[52] U.S. Cl. ..... 355/15; 15/256.51; 118/652

[58] Field of Search ..... 355/15; 118/652; 15/256.51, 256.52

[56] References Cited

U.S. PATENT DOCUMENTS 3,917,397 11/1975 Tanaka et al. ..... 355/15

3,955,235 5/1976 Meyer ..... 355/15 X

OTHER PUBLICATIONS

*IBM Tech. Disc. Bull.,* vol. 19, No. 3, Aug. 1976, p. 808.

*IBM Tech. Disc. Bull.,* vol. 16, No. 7, Dec. 1973, p. 2112.

*Primary Examiner*—Richard L. Moses

*Attorney, Agent, or Firm*—David G. Alexander

[57] ABSTRACT

A cylindrical electrode (26) is disposed in a tubular housing (22) and applied with an electric potential opposite in polarity to a charge on usable toner particles removed from a photoconductive drum (13). A fur brush (21) bifunctions to remove the toner and foreign matter from the drum (13) and create an air flow which carries the toner and foreign matter through a passageway (41) defined between the housing (22) and cylinder (26). The foreign matter is carried into a foreign matter chamber (29) by centrifugal force while the toner adheres to the cylinder (26) which is rotated in the same direction as the air flow. The toner is carried past a blade (34) which extends closely adjacent to the cylinder (26) into a toner recovery chamber (31) from which it is scrapingly removed from the cylinder (26) and recycled.

14 Claims, 5 Drawing Figures

Fig. 3
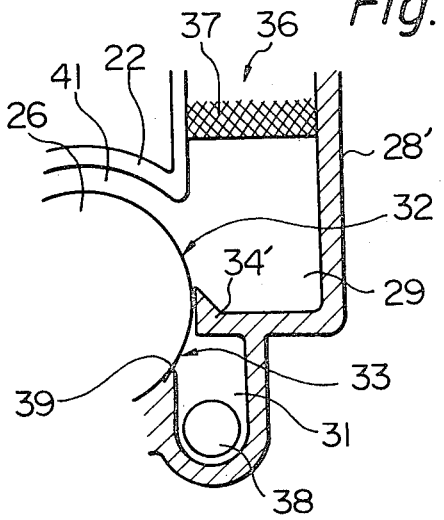
Fig. 4
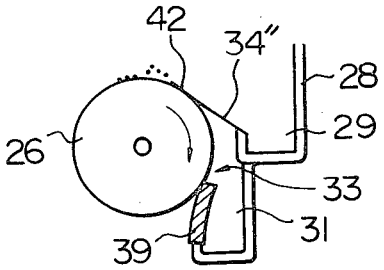
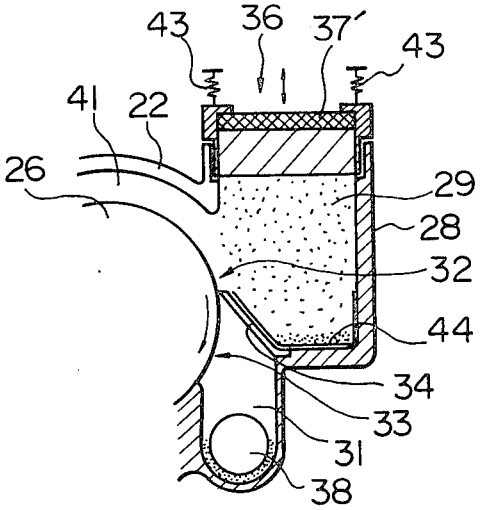
Fig. 5

TONER SEPARATION AND RECOVERY APPARATUS

BACKGROUND OF THE INVENTION

The present invention relates to a toner separation and recovery apparatus for enabling recycling of toner in an electrostatic copying machine or similar electrostatographic apparatus.

In such an apparatus an electrostatic image is formed on a photoconductive drum which constitutes a dielectric member in the absence of light. Alternatively, the electrostatic image may be formed directly on a non-photoconductive dielectric member through electrostatic discharge. Toner is applied to the drum or other member to produce a toner image which is transferred and fixed to a copy sheet to provide a permanent reproduction of an original document.

Since the transfer efficiency is not perfect, a certain amount of toner in the form of a residual toner image remains on the drum after the transfer operation. This must be removed from the drum prior to the formation of a new electrostatic image to prevent the formation of a double image. It is desirable from the standpoint of conservation and economy to recycle the toner removed from the drum back to the developing unit. However, various problems such as the formation of incomplete or abnormal toner images, scattering of toner particles in the apparatus and contamination of white background areas in the copies result from the fact that the recycled toner is mixed with foreign matter and toner which was charged to a polarity opposite to the desired polarity. If, for example, the electrostatic image has a negative polarity, the toner should have a positive charge so as to be attracted to the electrostatic image. If the toner is positively charged, it will be repelled by the electrostatic image and result in an incomplete toner image.

SUMMARY OF THE INVENTION

A toner separation and recovery apparatus embodying the present invention includes removal means for removing usable toner and foreign matter from a dielectric member after transfer of a toner image from the dielectric member to another member, and is characterized by comprising a passageway, a toner recovery chamber and a foreign matter chamber, blower means for causing air flow through the passageway from the removal means to the toner recovery chamber and the foreign matter chamber, the toner recovery chamber being disposed downstream of the foreign matter chamber, electrode means having a surface defining a wall of the passageway, toner recovery chamber and foreign matter chamber and moving in a direction of the air flow, power source means for applying an electric potential to the electrode means having a polarity opposite to an electrostatic charge on the usable toner, and separator means for separating the toner recovery chamber from the foreign matter chamber and extending closely adjacent to said surface of the electrode means.

In accordance with the present invention, a cylindrical electrode is disposed in a tubular housing and applied with an electric potential opposite in polarity to a charge on usable toner particles removed from a photoconductive dru. A fur brush bifunctions to remove the toner and foreign matter from the drum and create an air flow which carries the toner and foreign matter through a passageway defined between the housing and cylinder. The foreign matter is carried into a foreign matter chamber by centrifugal force while the toner adheres to the cylinder which is rotated in the same direction as the air flow. The toner is carried past a blade which extends closely adjacent to the cylinder into a toner recovery chamber from which it is removed from the cylinder and recycled.

It is an object of the present invention to provide an improved toner separation and recovery apparatus which enables recycling of only usable toner.

It is another object of the present invention to provide an improved means of preventing distorted toner images resulting from recycling of contaminated toner.

It is another object of the present invention to provide a generally improved toner separation and recovery apparatus.

Other objects, together with the foregoing, are attained in the embodiments described in the following description and illustrated in the accompanying drawing.

BRIEF DESCRIPTION OF THE DRAWING

FIGS. 3 to 5 are fragmentary views illustrating various modifications of the present apparatus.

DESCRIPTION OF THE PREFERRED EMBODIMENTS

While the toner separation and recovery apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
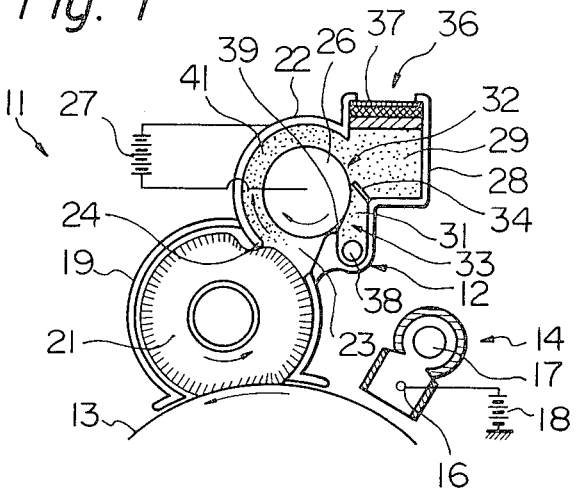
FIG. 1 is a schematic view of a toner separation and recovery apparatus embodying the present invention.
Figure 2:
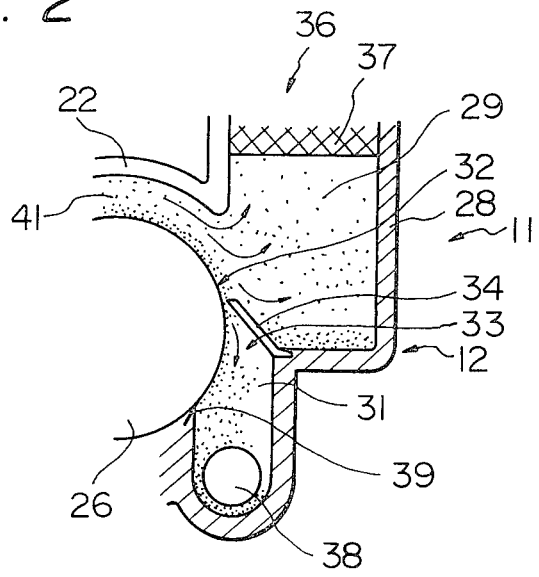
FIG. 2 is an enlarged view showing part of the apparatus of FIG. 1.

Referring now to FIGS. 1 and 2 of the drawing, a toner separation and recovery apparatus embodying the present invention is generally designated by the reference numeral 11 and comprises a housing 12 which is disposed closely adjacent to a dielectric member in the form of a photoconductive drum 13. The housing 12 is disposed downstream of a transfer station (not shown) in which a toner image is transferred to a copy sheet. However, the drum 13 still carries a residual toner image due to incomplete transfer. The drum 13 is simultaneously charged and radiated with light to cause photoconductivity by a charging unit 14 which comprises a corona discharge electrode 16 and lamp 17. A power source 18 applies an electric potential to the electrode 16 having the same polarity as the charge on the toner particles. Where the polarity of an electrostatic image on the drum 13 is negative, the toner is positively charged and the voltage applied to the electrode 16 is also positive. Alternatively, the voltage applied to the electrode 16 may be A.C. with a positive D.C. bias.

The housing 12 comprises an electrically insulative tubular portion 19 in which is disposed a brush 21 which engages with the drum 13. The brush 21 may be made of fur or a material such as teflon which is negative relative to the toner in the triboelectric series. Where the drum 13 is rotated counterclockwise as illustrated, the brush 21 is also rotated counterclockwise to frictionally remove the toner from the drum 13.

The housing 12 further comprises an electrically conductive tubular portion 22 which communicates with the portion 19 as indicated at 23. A counterclockwise circumferential edge of the housing portion 22 constitutes a flicker bar 24 which engages with the brush 21 to deflect the bristles thereof and cause the toner to be flicked into the portion 22. Rotation of the brush 21 also creates an air flow through the portion 22 in the clockwise direction which carries the toner and any foreign matter mixed therewith clockwise through the portion 22.

Rotatably disposed in the housing portion 22 is a cylindrical electrode 26. The electrode 26 is rotated clockwise (in the same direction as the air flow) in coaxial relation with the portion 22. A power source 27 applies a negative charge (opposite to the polarity of the toner) to the electrode 26 and may additionally apply a positive charge to the housing portion 22 which in such a case would constitute a counter electrode.

The housing 12 further comprises an electrically insulative portion 28 which defines therein a foreign matter chamber 29. Disposed downstream of the chamber 29 is a toner recovery chamber 31. The chambers 29 and 31 communicate with the portion 22 as indicated at 32 and 33 respectively. The polarity of the power source 27 will be reversed where negatively charged toner is used.

The chambers 29 and 31 are separated from each other by a blade 34 which extends inwardly from the housing 12 closely adjacent to the cylinder 26. Typically, a clearance of 0.1 to 0.5 mm will be provided between the blade 34 and cylinder or electrode 26.

The chamber 29 is formed with an upper outlet 36 in which is mounted a filter 37. The lower portion of the chamber 31 is formed with an outlet 38 which leads to a toner container of a developing unit (not shown). Further illustrated is a blade 39 extending from the housing 12 into scraping engagement with the cylinder 26.

In operation, the toner and foreign matter in addition to oppositely charged toner particles which are unusable are removed from the drum 13 by the brush 21 and carried through the housing portion 22 by the air stream. The space between the housing 22 and cylinder 26 constitutes a passageway 41 leading to the chambers 29 and 31. Foreign matter and oppositely (negatively) charged toner particles are carried by centrifugal force into the chamber 29. The air escapes from the chamber 29 through the outlet 36 while the foreign matter and oppositely charged toner particles are carried into the chamber 29 or trapped by the filter 37.

The usable toner particles, which carry a positive charge, are attracted to the negatively charged cylinder 26. The usable toner particles either adhere to the cylinder 26 due to electrostatic attraction or move along therewith at a very close spacing due to the repulsion of toner particles actually adhered to the cylinder 26. The usable toner particles are carried in this manner by the cylinder 26 past the blade 34 into the chamber 31 in which they are removed from the cylinder 26 by the blade 39. The toner particles thus discharged into the chamber 31 are recycled to the developing unit through the outlet 38. In summary, the foreign matter and oppositely charged toner particles are not attracted to the electrode cylinder 26 and are carried by the air flow and centrifugal force into the chamber 29 from which they may be removed at a convenient time. The usable toner particles are attracted to the cylinder 26 and carried thereby into the chamber 31 from which they are recycled. Since the usable toner particles adhere to the cylinder 26 or move closely adjacent therewith, they are able to pass through the gap between the blade 34 and cylinder 26. The blade 34, of course, prevents the foreign matter and oppositely charged toner from entering the chamber 31.

Whereas the blade 34 is formed separately and mounted on the housing portion 28, FIG. 3 illustrates a modified blade 34' which is formed integrally with a housing portion 28'.

Whereas the blades 34 and 34' are rigid, FIG. 4 illustrates a flexible blade 34'' made of, for example, 100 micron thick MYLAR. Whereas the blades 34 and 34' are spaced from the cylinder 26, the blade 34'' resiliently engages with the cylinder 26 with a small force which is insufficient to remove toner from the cylinder 26. In addition, the blade 34'' extends past a point of engagement with the cylinder 26 which is indicated at 42 to collect toner which is slightly spaced from the cylinder 26.

FIG. 5 illustrates several alternative modifications which serve to yet further improve the operation of the apparatus. A modified filter 37' is supported by springs 43 and thereby allowed to vibrate. Shocks and vibrations resulting from the operation of the copying machine will cause the filter 37' to vibrate and shake off the foreign matter and oppositely charged toner which was trapped thereby so that said matter will fall downwardly into the chamber 29. Another improvement is a detachable tray 44 provided at the bottom of the chamber 29 which may be removed from the housing 12 to facilitate disposal of the foreign matter.

In summary, it will be seen that the present invention provides an improved toner separation and recovery apparatus which enables recycling of only usable toner. Various modifications will become possible for those skilled in the art after receiving the teachings of the present disclosure without departing from the scope thereof.

What is claimed is:

1. A toner separation and recovery apparatus including removal means for removing usable toner and foreign matter from a dielectric member after transfer of a toner image from the dielectric member to another member, characterized by comprising:

a passageway means, a toner recovery chamber and a foreign matter chamber;

blower means for causing air flow through the passageway means from the removal means to the toner recovery chamber and the foreign matter chamber, the toner recovery chamber being disposed downstream of the foreign matter chamber;

electrode means having a surface defining a wall of the passageway means, toner recovery chamber and foreign matter chamber and moving in a direction of the air flow;

power source means for applying an electric potential to the electrode means having a polarity opposite to an electrostatic charge on the usable toner; and separator means for separating the toner recovery chamber from the foreign matter chamber and extending closely adjacent to said surface of the electrode means;

the separator means comprising a blade extending inwardly from the housing.

2. An apparatus as in claim 1, in which the removal means and blower means are integral and comprise a rotating brush.

3. An apparatus as in claim 2, further comprising a flicker bar engaging with the brush.

4. An apparatus as in claim 1, in which the passageway means comprises a tubular housing, the electrode means comprising a rotating cylinder disposed in the housing.

5. An apparatus as in claim 4, in which the cylinder is coaxially disposed in the housing.

6. An apparatus as in claim 4, in which the separator means comprises a blade extending inwardly from the housing.

7. An apparatus as in claim 1, in which the blade is formed integrally with the housing.

8. An apparatus as in claim 1, in which the blade is rigid.

9. An apparatus as in claim 1, in which the blade is flexible and engages with the cylinder.

10. An apparatus as in claim 9, in which the blade extends opposite to the direction of the air flow from the housing past a point of engagement of the blade with the cylinder.

11. An apparatus as in claim 1, in which the foreign matter chamber is formed with an outlet, the apparatus further comprising a filter mounted at the outlet.

12. A toner separation and recovery apparatus including removal means for removing usable toner and foreign matter from a dielectric member after transfer of a toner image from the dielectric member to another member, characterized by comprising:

a passageway means, a toner recovery chamber and a foreign matter chamber;

blower means for causing air flow through the passageway means from the removal means to the toner recovery chamber and the foreign matter chamber, the toner recovery chamber being disposed downstream of the foreign matter chamber;

electrode means having a surface defining a wall of the passageway means, toner recovery chamber and foreign matter chamber and moving in a direction of the air flow;

power source means for applying an electric potential to the electrode means having a polarity opposite to an electrostatic charge on the usable toner;

separator means for separating the toner recovery chamber from the foreign matter chamber and extending closely adjacent to said surface of the electrode means;

the foreign matter chamber being formed with an outlet, the apparatus further comprising a filter mounted at the outlet; and spring means supporting the filter for allowing vibration of the filter, the outlet being formed at an upper portion of the foreign matter chamber.

13. A toner separation and recovery apparatus including removal means for removing usable toner and foreign matter from a dielectric member after transfer of a toner image from the dielectric member to another member, characterized by comprising:

a passageway means, a toner recovery chamber and a foreign matter chamber;

blower means for causing air flow through the passageway means from the removal means to the toner recovery chamber and the foreign matter chamber, the toner recovery chamber being disposed downstream of the foreign matter chamber;

electrode means having a surface defining a wall of the passageway means, toner recovery chamber and foreign matter chamber and moving in a direction of the air flow;

power source means for applying an electric potential to the electrode means having a polarity opposite to an electrostatic charge on the usable toner; and separator means for separating the toner recovery chamber from the foreign matter chamber and extending closely adjacent to said surface of the electrode means;

the foreign matter chamber being formed with a detachable lower tray for allowing removal of foreign matter therefrom.

14. A toner separation and recovery apparatus including removal means for removing usable toner and foreign matter from a dielectric member after transfer of a toner image from the dielectric member to another member, characterized by comprising:

a passageway means, a toner recovery chamber and a foreign matter chamber;

blower means for causing air flow through the passageway means from the removal means to the toner recovery chamber and the foreign matter chamber, the toner recovery chamber being disposed downstream of the foreign matter chamber;

electrode means having a surface defining a wall of the passageway means, toner recovery chamber and foreign matter chamber and moving in a direction of the air flow;

power source means for applying an electric potential to the electrode means having a polarity opposite to an electrostatic charge on the usable toner; and separator means for separating the toner recovery chamber from the foreign matter chamber and extending closely adjacent to said surface of the electrode means;

the foreign matter chamber being formed with an outlet, the apparatus further comprising a filter mounted at the outlet.

* * * * *